US005956004A

United States Patent [19]

Hush et al.

[11] Patent Number: 5,956,004

[45] **Date of Patent: *Sep. 21, 1999**

[54] CONTROLLING PIXEL BRIGHTNESS IN A FIELD EMISSION DISPLAY USING CIRCUITS FOR SAMPLING AND DISCHARGING

[75] Inventors: Glen E. Hush; Thomas W. Voshell, both of Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/582,381

[22] Filed: Jan. 9, 1996

Related U.S. Application Data

[63] Continuation of application No. 08/305,107, Sep. 13, 1994, abandoned, which is a continuation of application No. 08/102,598, Aug. 5, 1993, abandoned, which is a continuation-in-part of application No. 08/060,111, May 11, 1993, abandoned.

[51] Int. Cl.[6] ..... G09G 3/22

[52] U.S. Cl. ..... 345/74; 345/77

[58] Field of Search ..... 345/63, 60, 77, 345/76, 55, 87, 88, 89, 105, 211, 212, 74, 75, 47; 315/169.1, 169.3, 169.4

[56] References Cited

U.S. PATENT DOCUMENTS

| | | | |
|---|---|---|---|
| 3,761,617 | 9/1973 | Tsuchiya et al. | 345/77 |
| 3,883,778 | 5/1975 | Kaji et al. | 345/63 |
| 4,020,280 | 4/1977 | Kaneko et al. | 345/63 |
| 4,353,062 | 10/1982 | Lorteije et al. | 340/767 |
| 4,514,727 | 4/1985 | Van Antwerp | 345/148 |
| 4,554,539 | 11/1985 | Graves | 345/211 |
| 4,743,096 | 5/1988 | Wakai et al. | 350/333 |
| 4,940,916 | 7/1990 | Borel et al. | 313/306 |
| 5,012,153 | 4/1991 | Atkinson et al. | 315/169.1 |
| 5,036,317 | 7/1991 | Buzak | 345/74 |
| 5,103,144 | 4/1992 | Dunham | 315/366 |
| 5,103,145 | 4/1992 | Doran | 315/381 |

(List continued on next page.)

FOREIGN PATENT DOCUMENTS

| | | | |
|---|---|---|---|
| 0381479 | 8/1990 | European Pat. Off. | 345/77 |
| 92/05571 | 4/1992 | WIPO | H01J 1/02 |

OTHER PUBLICATIONS

Charles A. Holt, "Electronic Circuits Digital and Analog", pp. 789–790 (1978).

U.S. application No. 08/637,353 Hush et al. filed Apr. 24, 1996.

U.S. application No. 08/991094 Hush et al. filed Dec. 15, 1997.

U.S. application No. 08/311,971, Hush et al. filed Sep. 26, 1994, as a continuation of U.S. application No. 08/790205, under which the present application claims priority under 35 USC 120.

U.S. application No. 08/790205, Casper et al., filed Feb. 5, 1997, as a continuation of the application which now has issued as U.S. Ser. No. 5616,991.

"The NTSC Signal Specifications", *Proceedings of The I–R–E–*, Jan. 1954, pp. 46–48.

"NTSC Signal Specifications", *Proceedings of The I–R–E*, Jan. 1954, pp. 17–19.

Walter Bruch, "The Pal Colour TV Transmission System", *IEEE Trans.–BTR*, V. BTR–12, 1966, pp. 87–100.

Bernard D. Loughlin, "The Pal Color Television System", *IEEE Trans.–BTR*, V. BTR–12, 1996.

*Primary Examiner*—Chanh Nguyen

*Attorney, Agent, or Firm*—Ozer Teitelbaum; Robert J. Stern

[57] ABSTRACT

A flat panel display, such as a Field Emission Display ("FED"), is disclosed having a gray scale generator. Input into the display, initially, is an analog signal having an amplitude. The gray scale generator includes a converter for converting the analog input signal to a sawtooth output signal having a height and width. Further, the width of the sawtooth output signal is responsive to the analog input signal's amplitude.

28 Claims, 8 Drawing Sheets

U.S. PATENT DOCUMENTS

| | | | |
|---|---|---|---|
| 5,153,483 | 10/1992 | Kishino et al. | 315/3 |
| 5,157,309 | 10/1992 | Parker | 315/169.1 |
| 5,162,704 | 11/1992 | Kobori et al. | 315/349 |
| 5,196,839 | 3/1993 | Johary et al. | 340/793 |
| 5,210,472 | 5/1993 | Casper et al. | 315/349 |
| 5,262,698 | 11/1993 | Dunham | 345/30 |
| 5,283,500 | 2/1994 | Kochanski | 315/58 |
| 5,313,140 | 5/1994 | Smith et al. | 315/169.1 |
| 5,357,172 | 10/1994 | Lee et al. | 315/167 |
| 5,387,844 | 2/1995 | Browning | 315/169.3 |
| 5,402,041 | 3/1995 | Kishino et al. | 315/169.1 |
| 5,424,618 | 6/1995 | Bertenshaw et al. | 315/324 |
| 5,616,991 | 4/1997 | Casper et al. | 315/167 |

CONTROLLING PIXEL BRIGHTNESS IN A FIELD EMISSION DISPLAY USING CIRCUITS FOR SAMPLING AND DISCHARGING

CROSS REFERENCE TO RELATED APPLICATION

This application is a continuation of application Ser. No. 08/305,107 filed Sep. 13, 1994, now abandoned, which is a continuation of application Ser. No. 08/102,598 filed Aug. 5, 1993, now abandoned, which is a continuation-in-part of application Ser. No. 08/060,111 filed May 11, 1993, now abandoned.

FIELD OF THE INVENTION

The present invention pertains to Field Emission Display ("FED") devices. More particularly, the invention relates to a system for controlling the gray scale range brightness of a FED.

BACKGROUND OF THE INVENTION

Until recently, the Cathode Ray Tube ("CRT") has been the primary device for displaying information. While having sufficient display characteristics with respect to color, brightness, contrast and resolution, CRTs are relatively bulky and power hungry. These failings, in view of the advent of portable laptop computers, has intensified demand for a display technology which is lightweight, compact, and power efficient.

One available technology are flat panel displays, and more particularly, Liquid Crystal Display ("LCD") devices. LCDs are currently used for laptop computers. However, these LCD devices provide poor contrast in comparison to CRT technology. Further, LCDs offer only a limited angular display range. Moreover, color LCD devices consume power at rates incompatible with extended battery operation. In addition, a color LCD type screen tends to be far more costly than an equivalent CRT.

In light of these shortcomings, there have been several developments recently in thin film, Field Emission Display ("FED") technology. In U.S. Pat. No. 5,210,472, commonly assigned with the present invention, and incorporated herein by reference, a FED design is disclosed which utilizes a matrix-addressable array of pointed, thin-film, cold emission cathodes in combination with a phosphor luminescent screen. Here, the FED incorporates a column signal to activate a single conductive strip within the cathode grid, while a row signal activates a conductive strip within the emitter base electrode. At the intersection of both an activated column and an activated row, a grid-to-emitter voltage differential exists sufficient to induce a field emission, thereby causing illumination of the associated phosphor of a pixel on the phosphorescent screen. Extensive research has recently made the manufacture of an inexpensive, low power, high resolution, high contrast, full color FED a more feasible alternative to LCDs.

In order to achieve the advantages of this technology, as in the performance of LCDs, FED devices require a gray scale range control scheme. Several techniques have been proposed to control the brightness and gray scale range. For example, inventor Dunham in U.S. Pat. No. 5,103,144, and inventor Doran in U.S. Pat. No. 5,103,145, both incorporated herein by reference, teach methods for controlling the brightness and luminance of flat panel displays. However, there remains a need for a gray scale range control scheme that requires less power, is simpler to manufacture. Further, a need exists for a gray scale control scheme requiring less circuitry and thus less surface area on a silicon die.

SUMMARY OF THE INVENTION

The primary advantage of the present invention is to eliminate the aforementioned drawbacks of the prior art.

A further advantage of the present invention is to provide a gray scale generator which requires less circuitry.

Still another advantage of the present invention is to provide a gray scale generator which requires less surface area on a silicon die.

Yet another advantage of the present invention is to provide a gray scale generator which requires less power consumption.

Yet another advantage of the present invention is to provide a gray scale generator that is simpler to manufacture.

Accordingly, a flat panel display of the present invention, such as a field emission display ("FED"), is disclosed having a gray scale generator. Input into the display, initially, is an analog signal having an amplitude. The display, by employing a gray scale generator, includes a means for converting the analog input to a sawtooth output signal having a height and width. Further, the width of the sawtooth output is responsive to the analog input signal's amplitude.

In another distinct embodiment of the present invention, means are included for adjusting the gray scale range of the flat panel display to provide contrast to the display.

In yet another distinct embodiment of the present invention, a sensor is also included for sensing ambient light surrounding the flat panel display, and means for modifying the pulse height in response to the ambient light sensor.

Other advantages will become apparent to those skilled in the art from the following detailed description read in conjunction with the appended claims and the drawings attached hereto.

BRIEF DESCRIPTION OF THE DRAWINGS

The present invention will be better understood from reading the following description of non-limitative embodiments, with reference to the attached drawings, wherein below.

It should be emphasized that the drawings of the instant application are not to scale but are merely schematic representations and are not intended to portray the specific parameters or the structural details of the invention, which can be determined by one of skill in the art by examination of the information herein.

DETAILED DESCRIPTION OF THE INVENTION

Figure 1:
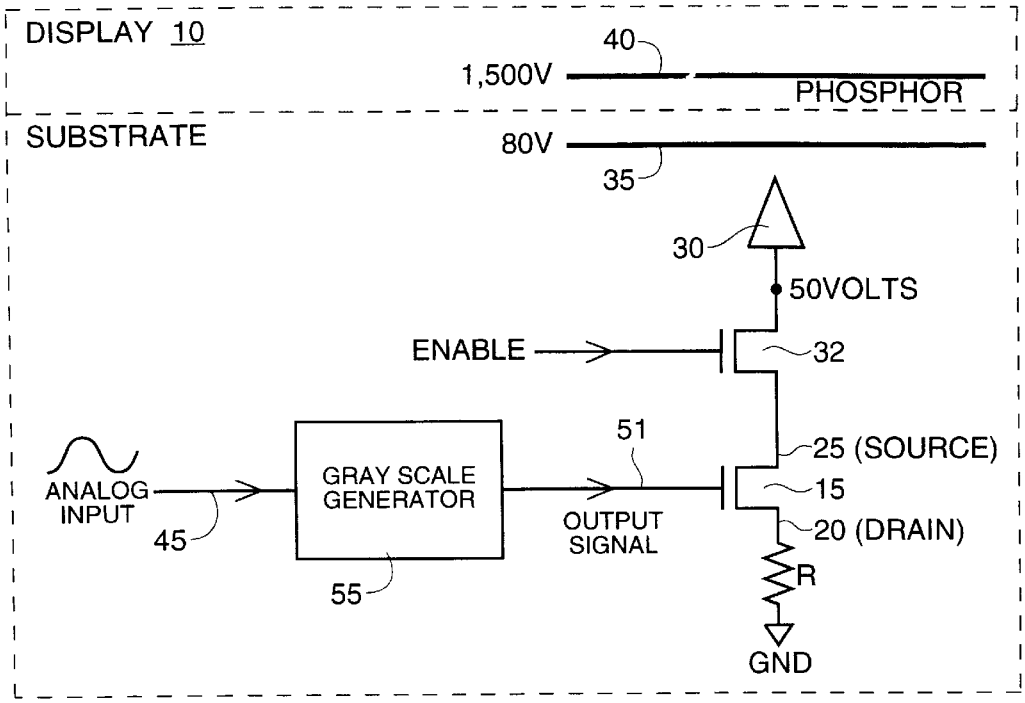
FIG. 1 is a schematic diagram of a field emission display device of the present invention.

In FIG. 1, an FED device 10 of the present invention is shown. FED device 10 comprises a field effect transistor ("FET") pixelator 15 having a drain 20 which is coupled to a resistor R and a source 25 which is coupled to a emitter tip 30. Further, coupled between source 25 and emitter 30 is a FET device 32 which is employed as an enable/disable switching device. It should be noted that the voltage potential from the emitter tip 30 to ground is sufficiently high so as to properly operate emitter tip 30. In one embodiment, this voltage potential is approximately 50 volts. However, it should be obvious to one of ordinary skill in the art that the emitter tip is functional at other predetermined voltages.

Emitter tip 30 is positioned in a vacuum near a first and second grid plate, 35 and 40, respectively. Both grid plates are biased, such that first grid plate 35 has a substantially lower voltage than second grid plate 40. In one embodiment, first grid plate 35 has a voltage of 80 volts, while second grid plate 40 has a voltage of 1500 volts. However, it should be obvious to one of ordinary skill in the art that these voltages can be varied without adversely affecting the overall functionality of FED device 10, so long as first grid plate 35 is substantially lower than second grid plate 40.

The voltage differential between grid plates 35 and 40 causes an electron to be emitted from emitter tip 30 and onto second grid plate 40. As second grid plate 40 comprises a phosphor background, the area of second grid plate 40 bombarded by the discharged electron is illuminated. FED 10 illuminates more brilliantly according to the number of electrons bombarding the phosphor background.

Given the direct relationship between the number of electrons bombarding the phosphor background and the illumination of the display, the present invention employs an output width signal scheme as an input to FET 15. In order to achieve brilliant illumination, an analog signal input 45 is transformed into a output width signal 51 by means of gray scale generator 55.

Figure 2A:
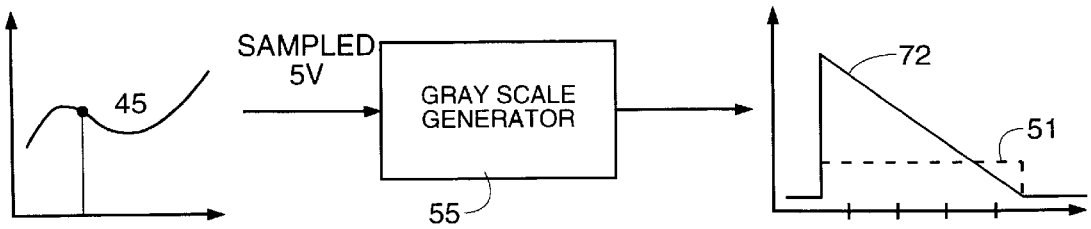
FIGS. 2(*a*) and (*b*) illustrate transfer functions of the present invention.
Figure 2B:
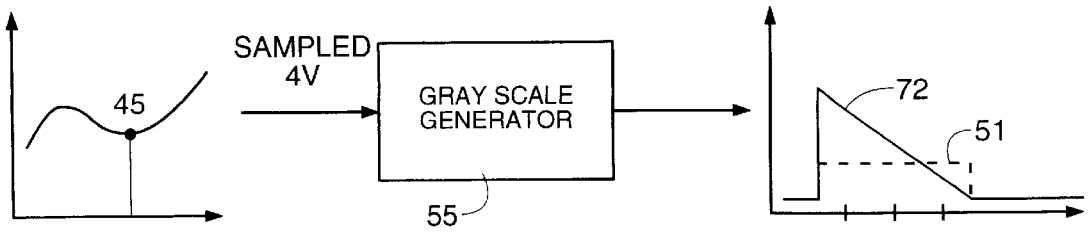

In FIGS. 2(*a*) and (*b*), the effects of gray scale generator 55 are illustrated. Analog signal input 45, upon being input to generator 55, is sampled at a predetermined frequency. The value of the sampled analog signal input 45 is then transformed into output signal 51 or 72 whose width directly corresponds to the sampled voltage. For example, in FIG. 2(*a*), the first sampled voltage is 5 volts, which corresponds to a longer width than that created by the second sampled voltage of 4 volts depicted in FIG. 2(*b*).

It should be noted, that depending on the configuration of generator 55, the output signal can comprise either a sawtooth or square pulse shape. In the event that a sawtooth shape configuration is selected, output signals 72 in FIGS. 2(*a*) and (*b*) have the same slope. Irrespective of the format selected, output signals 51 or 72 can either begin at the same time and end in different times, subject to the requisite signal width, or start at different times and end at the same time, subject to the requisite signal width.

Figure 3:
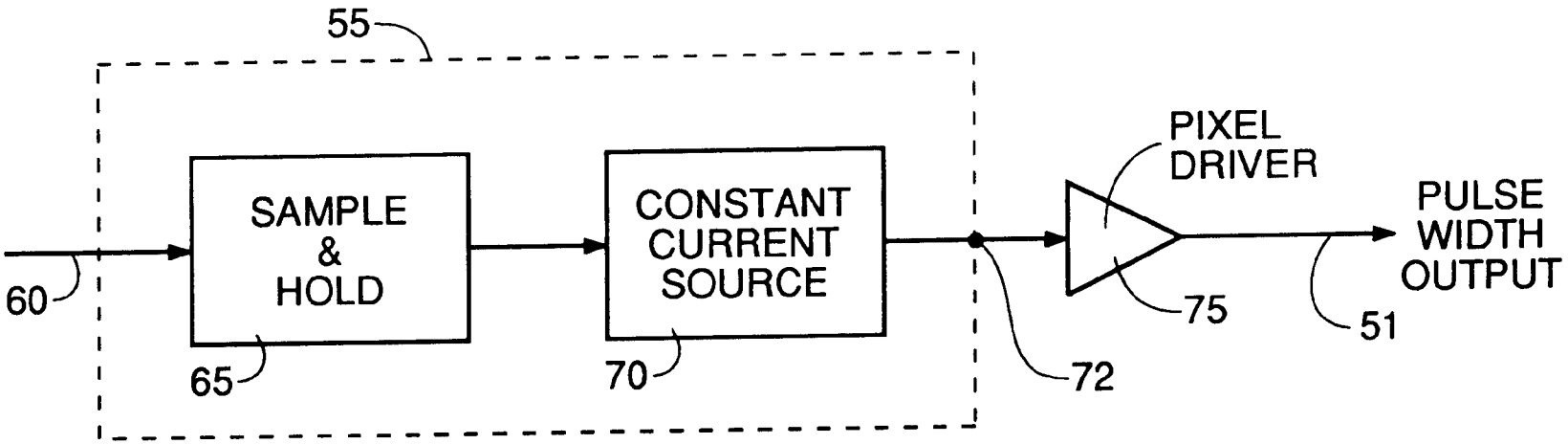
FIG. 3 is a block diagram corresponding to a portion of FIG. 1.
Figure 4A:
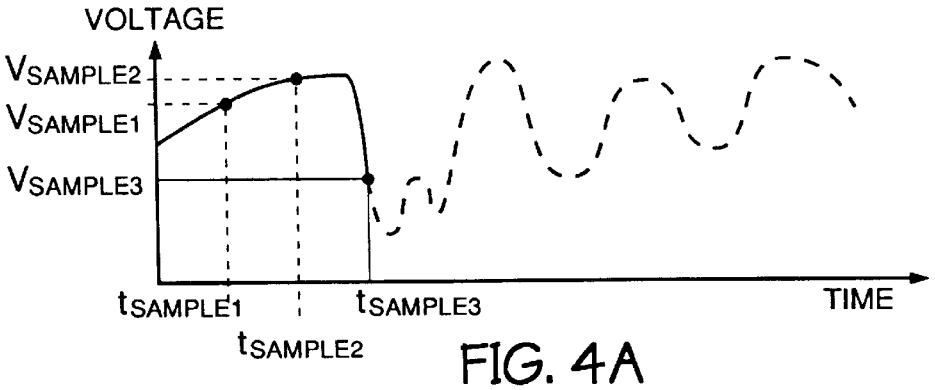
FIGS. 4(*a*)–(*d*) are illustrations of output signals of each stage of a preferred embodiment of the present invention.
Figure 4B:
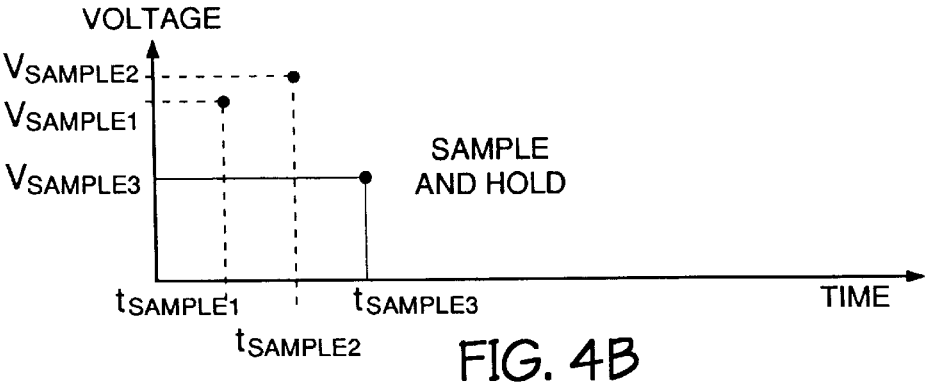
Figure 4C:
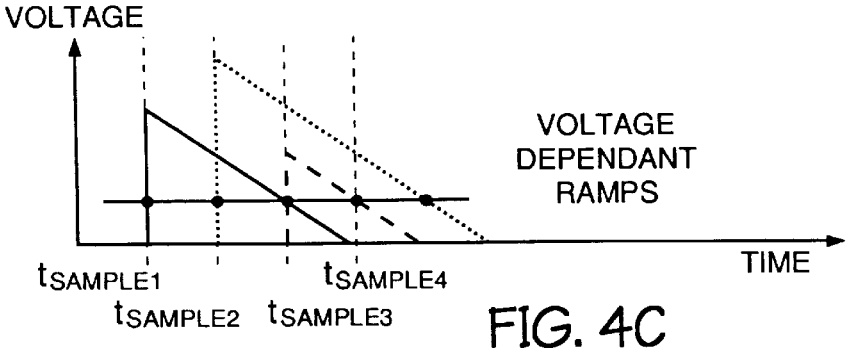
Figure 4D:
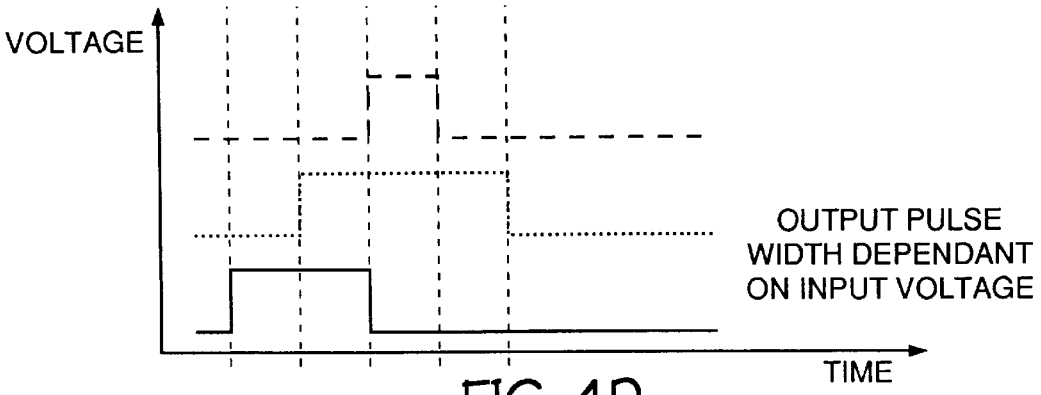

In FIG. 3, a block diagram corresponding to a portion of FIG. 1, describes gray scale generator 55. The purpose of generator 55 is to provide a means for controlling the gray scale range and brightness of a flat panel display, such as an FED. Gray scale range is definable as a range from the minimum to the maximum width values of the pulse width signal.

Upon receiving an analog signal 60 comprising a red, green and/or blue signal, in PAL signal or NTSC signal configuration, the present invention initially samples the signal at a predetermined frequency. Sampling is achieved by means of a sample circuit. Once sampled, the sample of signal 60 is held by a holding circuit which stores each sample, until the next sample is taken. Both the sample and hold functions are represented by sample and hold block 65.

Coupled to the output of sample and hold circuitry 65 is a constant current source 70. For the purposes of illustration, constant current source 70 is coupled directly to sample and hold circuitry 65. However, from a circuit perspective, coupling may be realized differently. Constant current source 70 is employed for the purpose of providing a means for discharging the output of sample and hold circuitry 65. Means for discharging, for example, can be realized by a current mirror circuit, though in the preferred embodiment, constant current source 70 comprises a variably compliant current source. Nonetheless, one of ordinary skill in the art may devise feasible alternatives. Thus, constant current source provides a predetermined current irrespective of the sampled voltage.

In one embodiment of the present invention, a pixel driver or buffer 75 is coupled to gray scale generator 55. Sawtooth output signal 72 of generator 55 is input into driver 75. Pixel driver 75 serves the functional purpose of generating a pulse width output signal 51. This purpose is achieved by comparing the sawtooth output signal 72 with a predetermined threshold. Thus, driver 75 converts sawtooth signal 72 to pulse width signal 51, whereby the width of signal 72 corresponds to the pulse width of signal 51, as shown in FIGS. 2(*a*) and (*b*).

In FIGS. 4(*a*)–(*d*), the outputs of each stage of the present invention are shown. With respect to FIG. 4(*a*), analog signal 45 is input to gray scale generator 55. Subsequently, analog signal 45 is sampled at a predetermined frequency. For example, at times $t_{sample1}$, $t_{sample2}$ and $t_{sample3}$, voltages $V_{sample1}$, $V_{sample2}$ $V_{sample3}$ are sampled from analog signal 45. FIG. 4(*b*) highlights the outputs of sample and hold circuitry 65 with respect to voltages $V_{sample1}$, $V_{sample2}$ and $V_{sample3}$.

As the output of sample and hold circuitry 65 is directly coupled to constant current source 70, a series of sawtooth ramps are generated. FIG. 4(*c*) depicts three sawtooth ramps. Each sawtooth ramp peak corresponds respectively to a sampled voltage, $V_{sample1}$, $V_{sample2}$ and $V_{sample3}$.

FIG. 4(*d*) illustrates one embodiment of the present invention, where each sawtooth ramp is converted into a pulse width signal. Pixel driver 75, being coupled to the output of gray scale generator 55, creates the pulse width signal for each sample. While the amplitude of the originally sampled analog signal 45 varies over time, the amplitude of each pulse width signal remains constant. However, the width of the pulse width signal directly corresponds to the amplitude of sampled analog signal input 60.

Figure 5:
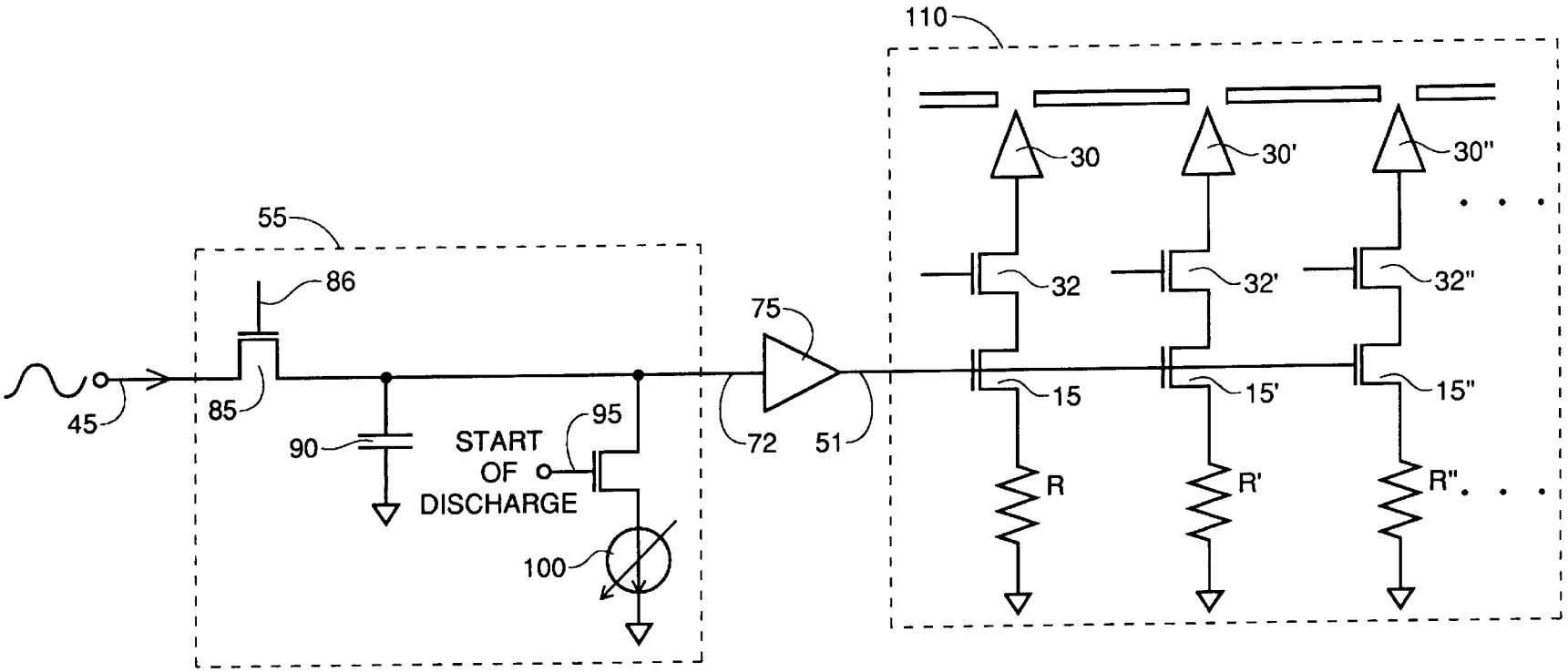
FIG. 5 illustrates a first realization of the present invention.

In FIG. 5, a first realization of the present invention is depicted. Here, each component of gray scale generator 55 can be viewed from a circuit perspective. Coupled to analog signal input 45 is sampling circuit 85. Sampling circuit 85 comprises a FET type transistor, whereby signal 45 is input to the channel of the FET. However, it should be obvious to one of ordinary skill in the art that the FET type transistor can be replaced with a switch for sampling the analog input 45. Sampling circuit 85, in the form of a FET transistor, comprises a sampling control signal 86. By coupling control signal 86 into the gate of the FET type transistor, analog signal input 45 can be sampled at a frequency corresponding to the periodicity of control signal 86.

Coupled between the second channel of the FET and ground is holding circuit 90. Holding circuit 90 stores each of the sampled voltages created by sampling circuit 85, and at the appropriate time, discharges each stored sampled voltage through a constant current source 100. Holding circuit 90 comprises a capacitor for charging at a predetermined time constant and discharging at a predetermined time constant from the sampled voltage. However, other feasible alternatives may be conceived by one of ordinary skill in the art.

Moreover, gray scale generator 55 comprises another discharging circuit for discharging each of the sampled voltages. This discharging circuit comprises two elements: start of discharge switching device 95 and constant current source 100. Start of discharge switching device 95, being coupled to the channel of the FET of sampling circuit 85, enables and disables coupling of constant current source 100 from the remaining circuitry. In the preferred embodiment of the present invention, constant current source 100 comprises a variably compliant current source.

The signal input to switching device 95 has the same periodicity as control signal 86. Unlike signal 86 which comprises shorter width pulses, however, the signal input to switching device 95 comprises a longer width pulse. Moreover, the signal input to switching device 95 is asserted after signal 86 to allow holding circuit 90 to hold and charge to the sampled voltage, and subsequently discharge. In the preferred embodiment, the time between the assertion of signal 86 and the signal input to switching device 95 is minimal.

Thus, constant current source 100 is coupled between ground and start of discharge switching device 95, and start of discharge switching device 95 is coupled between constant current source 100 and the channel of sampling circuit 85. While the arrangement of device 95 relative to current source 100 is not particular relevant to the circuit branch as a whole, the discharging circuit in this embodiment is connected to the channel of the FET. Nonetheless, other feasible alternatives may be conceived by one of ordinary skill in the art.

In the preferred embodiment, gray scale generator 55 is coupled directly with display 110, and more particularly, to the drain of FET input device 15 of the FED. In this design, the operating characteristics of FET input device 15, such as its $v_t$, may need to be adjusted to compensate for a sawtooth input, as opposed to a pulse input.

In another embodiment of the present invention, pixel driver 75 is coupled between gray scale generator 55 and display 110. Operation of pixel driver 75 has been discussed with reference to FIG. 3.

Figure 6:
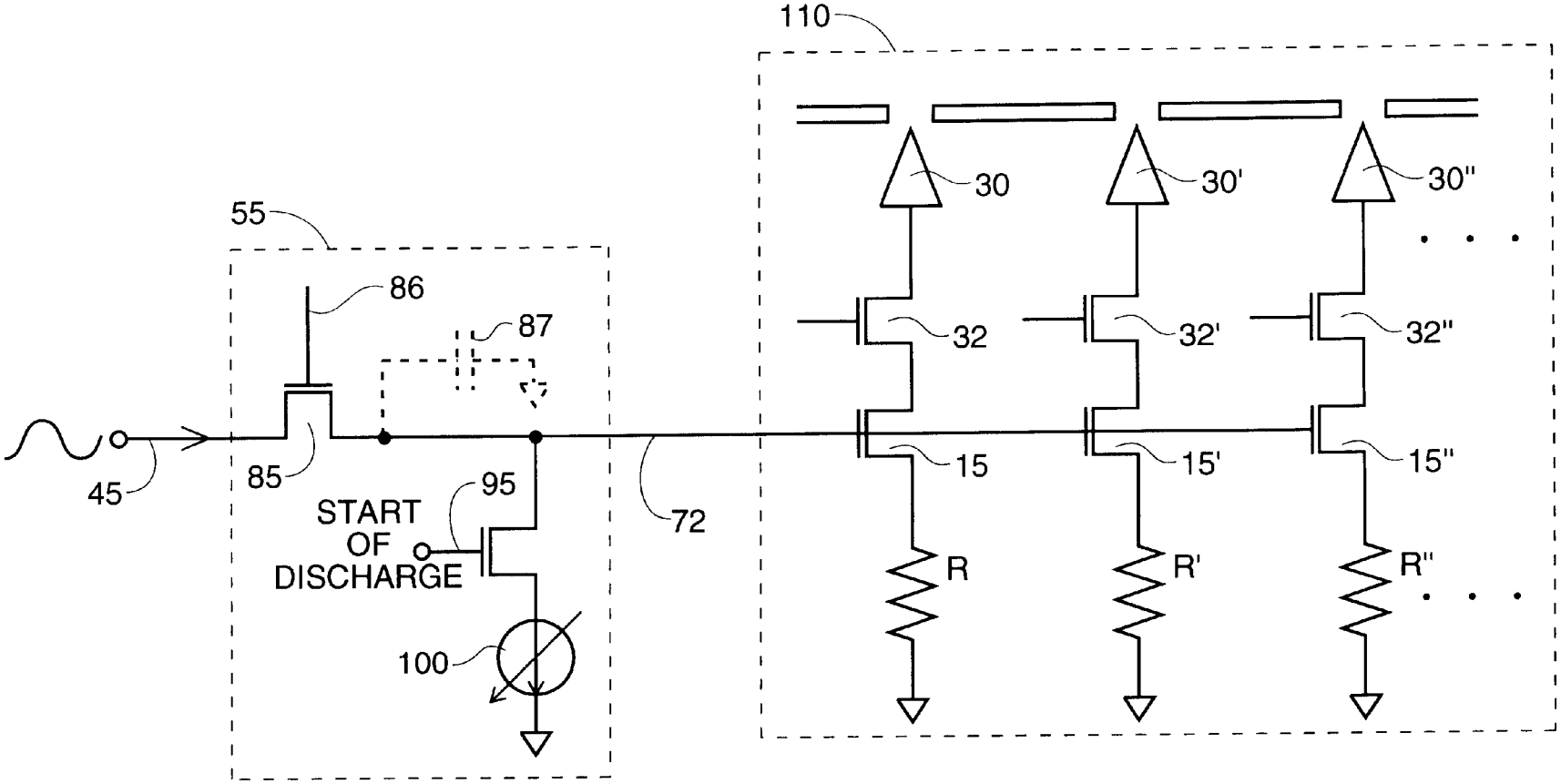
FIG. 6 illustrates a second realization of the present invention.

In FIG. 6, a second realization of the present invention is illustrated. Elements 45, 85, 86, 95 and 100 are structurally and functionally equivalent to similarly numbered elements discussed with reference to FIG. 5.

Coupled between the channel of the FET of the sampling circuit 85 and ground is a parasitic capacitance 87 inherent to display 110 and its configuration. This parasitic capacitance performs the functional equivalent of holding circuit 90 of FIG. 5. The parasitic capacitance of display 110 functionally stores each of the sampled voltages created by sampling circuit 85, and at the appropriate time, discharges each stored sampled voltage.

As a result of the above configuration, output signal 72 is generated from generator 55. Signal 72 is then input into display 110. Further, signal 72 comprises a sawtooth shape.

Figure 7:
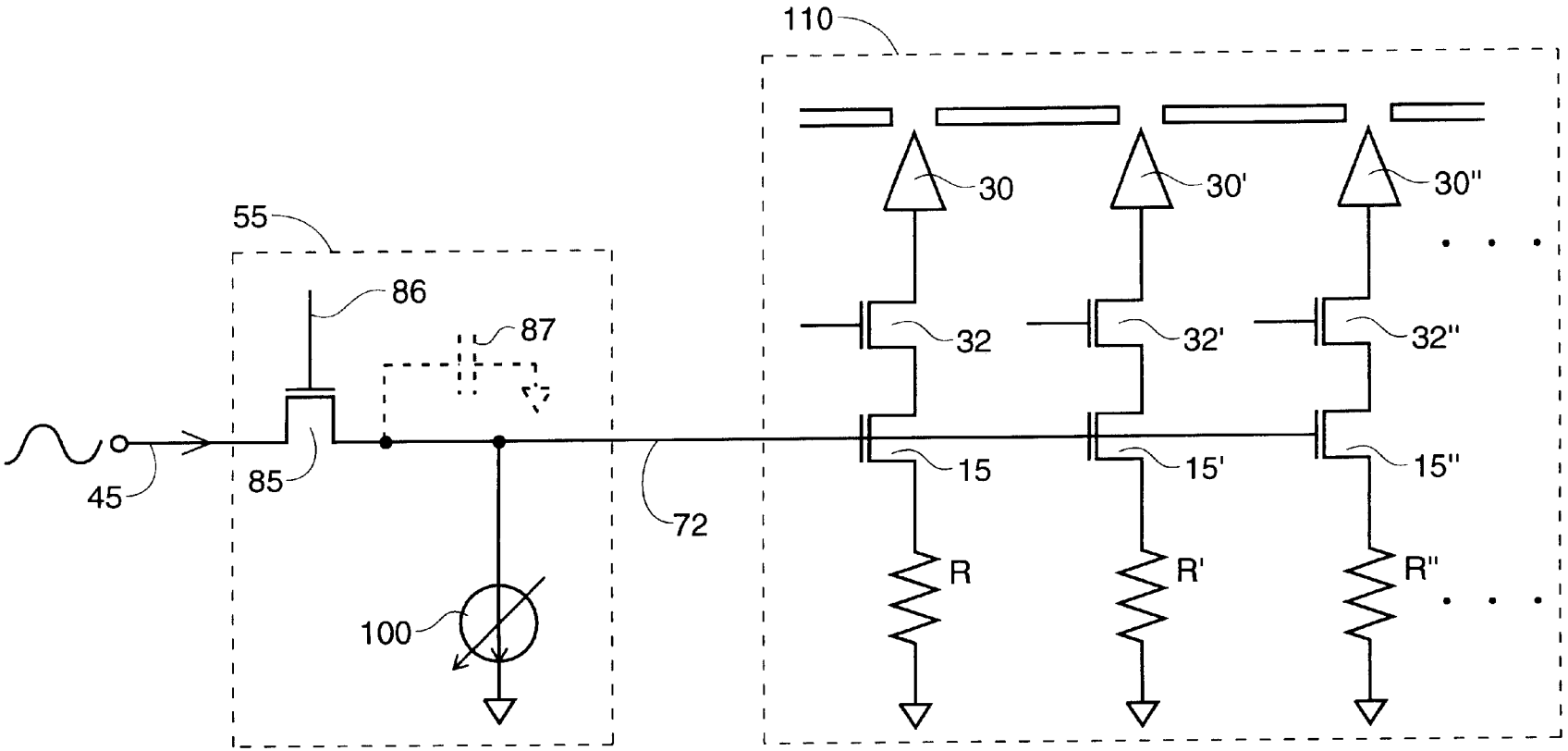
FIG. 7 illustrates a preferred realization of the present invention.

In FIG. 7, a third and preferred realization of the present invention is illustrated. Elements 45, 85, 86, 87, 100, and 72 are structurally and functionally equivalent to similarly numbered elements discussed with reference to FIG. 6.

As a result of the above configuration, output signal 72 is generated from generator 55. Signal 72 is then input into display 110. Further, signal 72 comprises a sawtooth shape.

Figure 8:
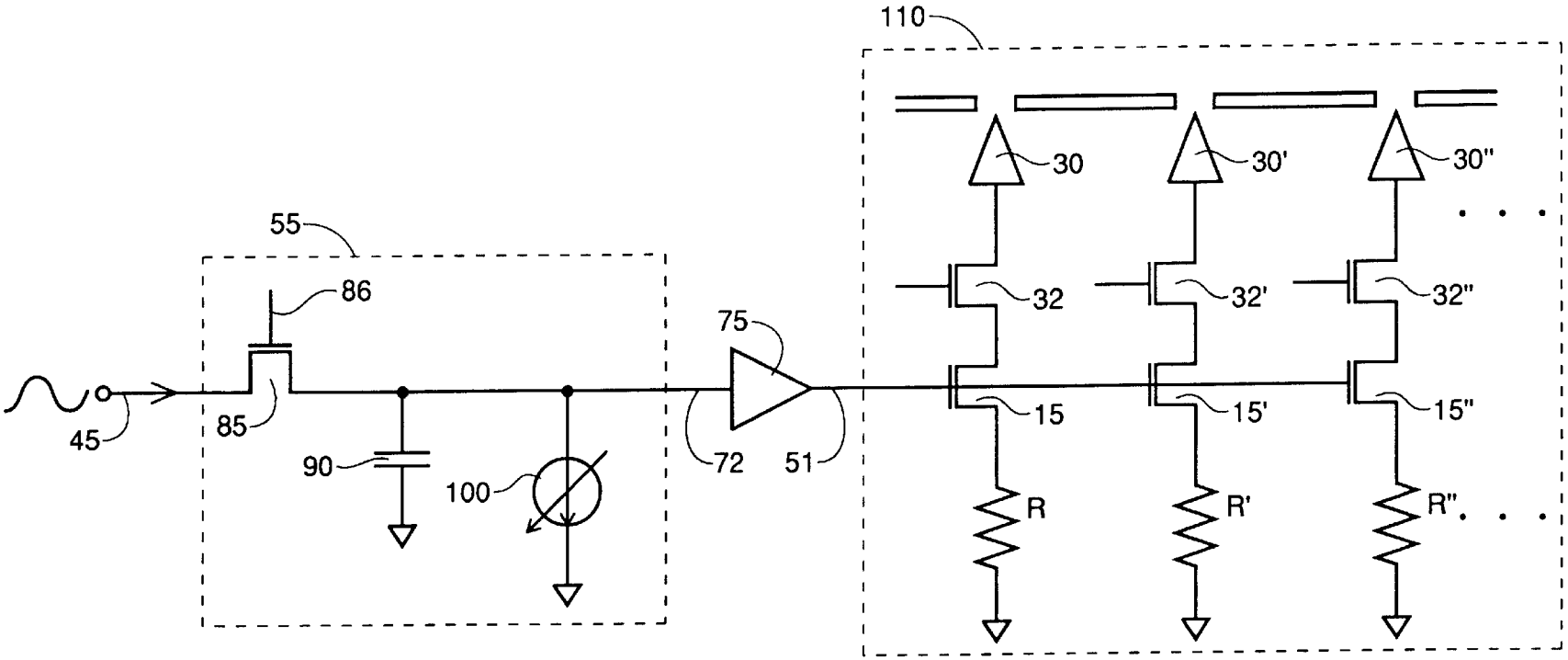
FIG. 8 illustrates another realization of the present invention.

Referring to FIG. 8, a fourth realization of the present invention is depicted.

Elements 45, 85, 86, 90, 100, 72, 75, and 51 are structurally and functionally equivalent to similarly numbered elements discussed with reference to FIG. 6.

Figure 9A:
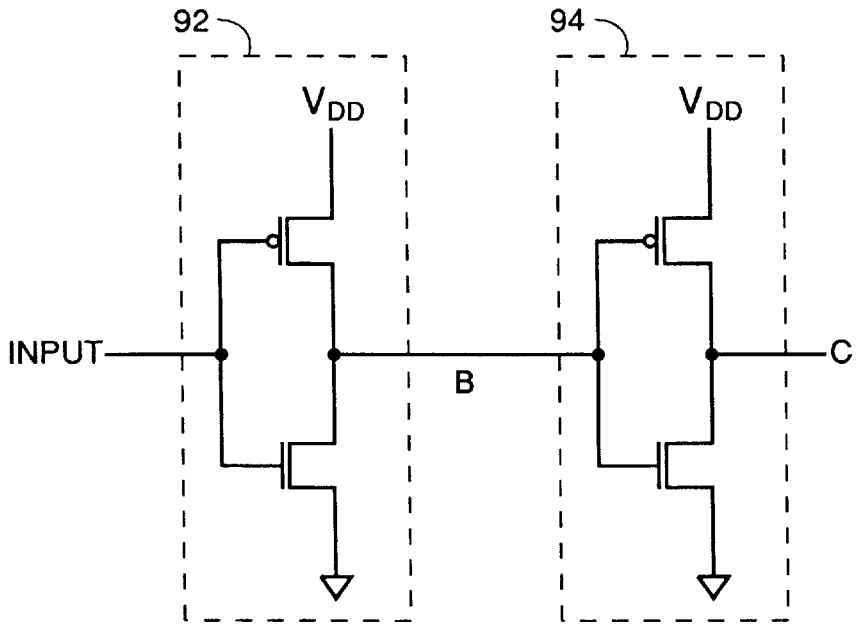
FIG. 9(*a*) is a schematic of pixel driver 75 and FIG. 9(*b*) illustrates its output characteristics.
Figure 9B:
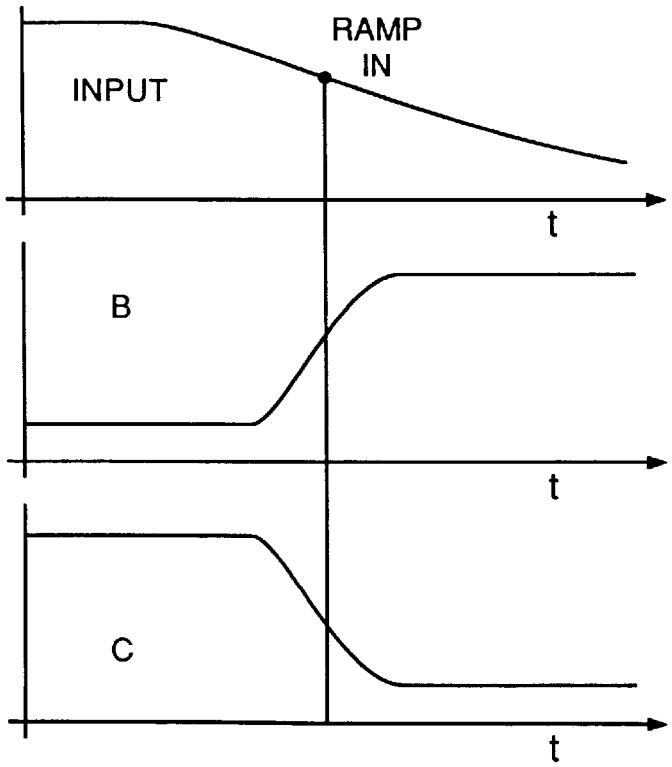

Referring to FIG. 9(*a*), a first realization of a pixel driver 75 is shown. Driver 75 essentially comprises two complementary metal oxide semiconductor ("CMOS") inverters, 92 and 94. Receiving sawtooth output signal 72 from generator 55 as an input to driver 75, as shown in FIG. 9(*b*), an inverted output with an associated time constant is generated by inverter 92. Subsequently, the output propagated by device 92 is input and inverted by inverter 94 with an associated time constant. With respect to driver 85, a voltage threshold level exists along its output. This threshold level pertains to the trip point to which the output pulse width signal is to be deemed high or low.

In a further embodiment of the present invention, means are provided for controlling the amplitude of the output pulse signal. This means increases or decreases amplitude of the output pulse signal. The functional purpose of this embodiment is to compensate for ambient light surrounding the FED. To facilitate this compensation, a sensor for sensing the ambient light is required, as is a means for amplifying the pulse height in response to the ambient light sensor's readings.

In still another embodiment of the present invention, a contrast control means is provided. As gray scale range is definable as the minimum and the maximum width values of the pulse width signal, the contrast control means can expand or contract the gray scale range of the FED. To achieve this purpose, circuitry is provided to facilitate greater on demand ramping control. By doing so, the pulse width range can be expanded or contracted. This is primarily achieved by employing a control circuit over the voltage controlled resistance. It should be obvious to one of ordinary skill in the art that this can be realized by a variety of techniques.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. It is therefore contemplated that the appended claims will cover any such modifications or embodiments as fall within the true scope of the invention.

All of the U.S. Patents cited herein are hereby incorporated by reference as if set forth in their entirety.

What is claimed is:

1. A field emission display having a pixel whose brightness varies in response to an analog pixel intensity voltage corresponding to that pixel, comprising:

a) a pixel including at least one field emitter tip;

b) an analog input for receiving the analog pixel intensity voltage for the pixel;

c) a capacitance;

d) a sampling switch connected between the analog input and the capacitance, wherein the switch periodically alternates between an on state and an off state so that, when the input switch is in its on state, the switch connects the analog pixel intensity voltage to the capacitance so that the capacitance charges up to a voltage proportional to a current sample of the analog pixel intensity voltage;

e) a discharge circuit, connected across the capacitance, for discharging the capacitance at a controlled rate while the sampling switch is in its off state so as to produce across the capacitance, each time the sampling switch switches from its on state to its off state, a progressively declining sawtooth voltage pulse having a peak amplitude and a pulse width both proportional to the current sample of the analog pixel intensity voltage, wherein the periodic alternation of the sampling switch produces periodic sawtooth voltage pulses across the capacitance;

f) an emitter control circuit having a control input and having an output connected to the at least one emitter tip, wherein the emitter control circuit conducts to the at least one emitter tip an electrical current whose value is proportional to a signal received at the control input; and g) a driver circuit, connected between the capacitor and the control input, for applying to the control input an electrical signal responsive to the periodic sawtooth voltage pulses across the capacitance.

2. A field emission display according to claim 1, wherein the discharge circuit is a constant current source.

3. A field emission display according to claim 1, wherein the emitter control circuit comprises a transistor having a channel and a gate, wherein the channel is connected between the at least one emitter tip and a source of electrical current, and wherein the gate is connected to the control input of the emitter control circuit.

4. A field emission display according to claim 3, wherein the emitter control circuit further comprises:

a resistor connected between the channel of the transistor and the source of electrical current.

5. A field emission display according to claim 1, wherein the capacitance consists essentially of parasitic capacitance of the display.

6. A field emission display according to claim 1, wherein the driver circuit comprises:

a voltage comparator circuit, connected between the capacitance and the control input of the emitter control circuit, for comparing the sawtooth voltage across the capacitance to a threshold voltage so as to provide to the control input a rectangular pulse signal which alternates between first and second distinct amplitudes, wherein the rectangular pulse signal has the first amplitude when the sawtooth voltage is above the threshold voltage and has the second amplitude when the sawtooth voltage is below the threshold voltage, so that the rectangular pulse signal has a pulse width determined by the pulse width of the sawtooth voltage.

7. A field emission display according to claim 1, wherein the driver circuit consists essentially of an electrical conductor directly connecting the capacitance to the control input of the emitter control circuit.

8. A method of controlling the electrical current flow to the field emitter tips of a pixel of a field emission display in response to an analog pixel intensity voltage corresponding to that pixel, comprising the steps of:

providing a pixel including at least one field emitter tip and a capacitance;

receiving an analog pixel intensity voltage for the pixel;

conducting to said at least one emitter tip of the pixel an electrical current proportional to a control signal received at a control input;

at periodic time intervals, alternately connecting and disconnecting the analog pixel intensity voltage to the capacitance so that, during the time intervals when the analog pixel intensity voltage is connected to the capacitance, the capacitance charges up to a voltage proportional to a current sample of the analog pixel intensity voltage;

discharging the capacitance at a controlled rate during the time intervals when the analog pixel intensity voltage is disconnected from the capacitance so as to produce across the capacitance, each time the analog pixel intensity voltage is disconnected from the capacitance, a progressively declining sawtooth voltage pulse having a peak amplitude and a pulse width both proportional to the current sample of the analog pixel intensity voltage, wherein said periodic connecting and disconnecting of the analog pixel intensity voltage produces periodic sawtooth voltage pulses across the capacitance; and applying to the control input an electrical signal responsive to the periodic sawtooth voltage pulses across the capacitance.

9. A method according to claim 8, wherein the step of applying an electrical signal to the control input consists essentially of directly connecting the capacitance to the control input.

10. A method according to claim 8, wherein the step of applying an electrical signal to the control input comprises the steps of:

receiving said sawtooth voltage from the capacitance;

comparing the amplitude of the sawtooth voltage received from the capacitance to a threshold voltage so as to produce a rectangular pulse signal which alternates between first and second distinct amplitudes, wherein the rectangular pulse signal has the first amplitude when the sawtooth voltage is above the threshold voltage and has the second amplitude when the sawtooth voltage is below the threshold voltage, so that the rectangular pulse signal has a pulse width determined by the pulse width of the sawtooth voltage; and applying the rectangular pulse signal to the control input.

11. A method according to claim 8, wherein the step of discharging the capacitance at a controlled rate comprises conducting a constant electrical current from the capacitance.

12. A method according to claim 8, wherein the step of conducting an electrical current to said at least one emitter tip comprises the steps of:

providing a source of electrical current;

providing a transistor having a channel and a gate;

connecting the channel between said at least one emitter tip and the source of electrical current; and connecting the gate to the control input.

13. A method according to claim 12, wherein the step of conducting an electrical current to said at least one emitter tip further comprises the step of:

connecting a resistor between the channel of the transistor and the source of electrical current.

14. A method according to claim 8, wherein the capacitance provided in the step of providing a pixel consists essentially of parasitic capacitance within the display.

15. A field emission display having a pixel whose brightness varies in response to an analog pixel intensity voltage corresponding to that pixel, comprising:

a pixel including at least one field emitter tip;

an analog input for receiving the analog pixel intensity voltage for the pixel;

a capacitance;

a sampling switch connected between the analog input and the capacitance, wherein the switch periodically alternates between an on state and an off state so that, when the input switch is in its on state, the switch connects the analog pixel intensity voltage to the capacitance so that the capacitance charges up to a voltage proportional to a current sample of the analog pixel intensity voltage;

a discharge circuit, connected across the capacitance, for discharging the capacitance at a controlled rate while the sampling circuit is in its off state so as to produce across the capacitance, each time the sampling switch switches from its on state to its off state, a progressively declining sawtooth voltage pulse having a peak amplitude and a pulse duration both proportional to the current sample of the analog pixel intensity voltage, wherein the periodic alternation of the sampling switch produces periodic sawtooth voltage pulses across the capacitance; and an emitter control circuit for conducting an electrical current to the at least one field emitter tip of the pixel only during the duration of each sawtooth voltage pulse.

16. A field emission display according to claim 15, wherein the discharge circuit is a constant current source.

17. A field emission display according to claim 15, wherein:

the emitter control circuit comprises a control input;

the emitter control circuit conducts said electrical current to the at least one field emitter tip in response to an electrical signal received at the control input; and the control input of the emitter control circuit is connected to the capacitance.

18. A field emission display according to claim 17, wherein the emitter control circuit comprises a transistor having a channel and a gate, wherein the channel is connected between the at least one emitter tip and a source of electrical current, and wherein the gate is connected to the control input of the emitter control circuit.

19. A field emission display according to claim 18, wherein the emitter control circuit further comprises:

a resistor connected between the channel of the transistor and the source of electrical current.

20. A field emission display according to claim 17, further comprising:

a voltage comparator circuit, connected between the capacitance and the control input of the emitter control circuit, for comparing the sawtooth voltage across the capacitance to a threshold voltage so as to provide to the control input of the emitter control circuit a rectangular pulse signal which alternates between first and second distinct amplitudes, wherein the rectangular pulse signal has the first amplitude when the sawtooth voltage is above the threshold voltage and has the second amplitude when the sawtooth voltage is below the threshold voltage, so that the rectangular pulse signal has a pulse width determined by the pulse width of the sawtooth voltage.

21. A field emission display according to claim 15, wherein the capacitance consists essentially of parasitic capacitance of the display.

22. A method of providing to the field emitter tips of a pixel of a field emission display a current flow responsive to an analog pixel intensity voltage corresponding to that pixel, comprising the steps of:

providing a pixel including at least one field emitter tip and a capacitance;

receiving an analog pixel intensity voltage for the pixel;

at periodic time intervals, alternately connecting and disconnecting the analog pixel intensity voltage to the capacitance so that, during the time intervals when the analog pixel intensity voltage is connected to the capacitance, the capacitance charges up to a voltage proportional to a current sample of the analog pixel intensity voltage;

discharging the capacitance at a controlled rate during time intervals when the analog pixel intensity voltage is disconnected from the capacitance so as to produce across the capacitance, each time the analog pixel intensity voltage is disconnected from the capacitance, a progressively declining sawtooth voltage pulse having a peak amplitude and pulse duration proportional to the current sample of the analog pixel intensity voltage, wherein said periodic connecting and disconnecting of the analog pixel intensity voltage produces periodic sawtooth voltage pulses across the capacitance; and conducting an electrical current to said at least one emitter tip of the pixel only during the duration of each sawtooth voltage pulse.

23. A method according to claim 22, wherein the step of discharging the capacitance at a controlled rate comprises conducting a constant electrical current from the capacitance.

24. A method according to claim 22, wherein the step of conducting an electrical current to said at least one emitter tip of the pixel comprises the steps of:

conducting said electrical current to said at least one field emitter tip in response to an electrical signal received at a control input; and connecting the capacitance to the control input.

25. A method according to claim 24, wherein the step of conducting said electrical current in response to an electrical signal received at a control input comprises the steps of:

providing a source of electrical current;

providing a transistor having a channel and a gate;

connecting the channel between said at least one emitter tip and the source of electrical current; and connecting the gate to the control input.

26. A method according to claim 25, wherein the step of conducting said electrical current in response to an electrical signal received at a control input further comprises the step of:

connecting a resistor between the channel of the transistor and the source of electrical current.

27. A method according to claim 24, wherein the step of connecting the capacitance to the control input comprises the steps of:

receiving said sawtooth voltage from the capacitance;

comparing the sawtooth voltage received from the capacitance to a threshold voltage so as to produce a rectangular pulse signal which alternates between first and second distinct amplitudes, wherein the rectangular pulse signal has the first amplitude when the sawtooth voltage is above the threshold voltage and has the second amplitude when the sawtooth voltage is below the threshold voltage, so that the rectangular pulse signal has a pulse width determined by the pulse width of the sawtooth voltage; and applying the rectangular pulse signal to the control input.

28. A method according to claim 22, wherein the capacitance provided in the step of providing a pixel consists essentially of parasitic capacitance within the display.

* * * * *